US011367381B2

(12) United States Patent
Cho et al.

(10) Patent No.: US 11,367,381 B2
(45) **Date of Patent: *Jun. 21, 2022**

(54) ELECTROLUMINESCENT DISPLAY DEVICE

(71) Applicant: LG Display Co., Ltd., Seoul (KR)

(72) Inventors: Young-Sung Cho, Goyang-si (KR); Chui Nam, Seoul (KR); Byeong-Seong So, Seoul (KR); Hyung-Uk Jang, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/135,928

(22) Filed: Dec. 28, 2020

(65) Prior Publication Data

US 2021/0201759 A1 Jul. 1, 2021

(30) Foreign Application Priority Data

Dec. 30, 2019 (KR) ..... 10-2019-0178616

(51) Int. Cl.
*G09G 3/30* (2006.01)

(52) U.S. Cl.
CPC ..... *G09G 3/30* (2013.01); *G09G 2300/0852* (2013.01); *G09G 2320/02* (2013.01); *G09G 2320/043* (2013.01)

(58) Field of Classification Search
CPC ..... G09G 3/30; G09G 2300/0852; G09G 2320/02; G09G 2320/043;
(Continued)

(56) References Cited

U.S. PATENT DOCUMENTS

2013/0194248 A1 8/2013 Kim
2015/0348464 A1 12/2015 In et al.
(Continued)

FOREIGN PATENT DOCUMENTS

JP 2008-040444 A 2/2008
KR 10-2012-0043301 A 5/2012
(Continued)

OTHER PUBLICATIONS

Taiwanese Office Action dated Nov. 2, 2021 issued in corresponding Patent Application No. 109146280 (6 pages).
(Continued)

*Primary Examiner* — Mark W Regn
(74) *Attorney, Agent, or Firm* — Polsinelli PC

(57) ABSTRACT

An electroluminescent display device has a plurality of pixels and each pixel includes a driving transistor having a gate connected to a first node, a source connected to a third node, and a drain connected to a fourth node, the driving transistor generating pixel current corresponding to a data voltage when a high-level source voltage is applied to the third node, an internal compensator comprising a first capacitor connected between the first node and a second node, and a second capacitor connected between the second node and an input terminal for the high-level source voltage, the internal compensator controlling a threshold voltage of the driving transistor with reference to a first scan signal, a second scan signal opposite to the first scan signal in phase, a third scan signal lagging the first scan signal in phase, a fourth scan signal leading the first scan signal in phase, and an emission signal, and a light emitting element connected between a fifth node to be connected to the fourth node and an input terminal for a low-level source voltage.

19 Claims, 16 Drawing Sheets

(58) Field of Classification Search
CPC ..... G09G 2300/043; G09G 2300/0819; G09G 2300/0861; G09G 2310/0251; G09G 2310/0262; G09G 2310/08; G09G 2320/045; G09G 2340/0435; G09G 3/3233
See application file for complete search history.

(56) References Cited

U.S. PATENT DOCUMENTS

| | | | | |
|---|---|---|---|---|
| 2017/0061876 | A1 | 3/2017 | Cho et al. | |
| 2017/0124941 | A1 | 5/2017 | Na et al. | |
| 2017/0256205 | A1 | 9/2017 | Zhu et al. | |
| 2018/0374425 | A1* | 12/2018 | Jeong | G06F 3/0412 |
| 2019/0043426 | A1 | 2/2019 | Zhang | |
| 2021/0201782 | A1* | 7/2021 | Jang | G09G 3/3233 |

FOREIGN PATENT DOCUMENTS

| | | | |
|---|---|---|---|
| KR | 10-2016-0081709 | A | 7/2016 |
| KR | 10-2017-0017990 | A | 2/2017 |
| KR | 10-2018-0025482 | A | 3/2018 |
| KR | 10-2018-0128122 | A | 12/2018 |
| WO | 2016/158481 | A1 | 3/2016 |

OTHER PUBLICATIONS

Japanese Office Action dated Dec. 7, 2021 issued in corresponding Patent Application No. 2020-207241 (4 pages).

* cited by examiner

ELECTROLUMINESCENT DISPLAY DEVICE

CROSS-REFERENCE TO RELATED APPLICATIONS

This application claims the benefit of Korean Patent Application No. 10-2019-0178616 filed on Dec. 30, 2019, which is hereby incorporated by reference in its entirety.

BACKGROUND

Field of the Disclosure

The present disclosure relates to an electroluminescent display device.

Description of the Background

Electroluminescent display devices are classified into an inorganic light emitting display device and an electroluminescent display device in accordance with materials of emission layers thereof. Each pixel of such an electroluminescent display device includes a light emitting element configured to emit light in a self-luminous manner, and adjusts luminance by controlling an emission amount of the light emitting element in accordance with a grayscale of image data. The pixel circuit of each pixel may include a driving transistor configured to supply pixel current to the light emitting element, and at least one switching transistor and a capacitor, which are configured to program a gate-source voltage of the driving transistor. The switching transistor, the capacitor, etc. may be designed to have a connection structure capable of compensating for threshold voltage variation of the driving transistor and, as such, may function as a compensation circuit.

Pixel current generated in the driving transistor is determined in accordance with the threshold voltage and the gate-source voltage in the driving transistor. In order to obtain desired luminance in such an electroluminescent display device, first, it is necessary to reduce influence of hysteresis characteristics of the driving transistor in the gate-source voltage of the driving transistor when the gate-source voltage of the driving transistor is programmed. Second, the compensation circuit should be optimally designed in order to prevent threshold voltage variation of the driving transistor from influencing pixel current. Third, the gate voltage of the driving transistor should be continuously maintained at a programmed voltage even during light emission of the light emitting element.

SUMMARY

Accordingly, the present disclosure is directed to an electroluminescent display device that substantially obviates one or more problems due to limitations and disadvantages of the prior art.

Aspects of the present disclosure provide an electroluminescent display device capable of alleviating hysteresis characteristics of a driving transistor before a gate-source voltage of the driving transistor is programmed, thereby optimally compensating for threshold voltage variation of the driving transistor.

In addition, aspects of the present disclosure provide an electroluminescent display device capable of continuously maintaining a gate voltage of a driving transistor at a programmed voltage even during light emission of a light emitting element.

Additional advantages, objects, and features of the present disclosure will be set forth in part in the description which follows and in part will become apparent to those having ordinary skill in the art upon examination of the following or may be learned from practice of the present disclosure. The objectives and other advantages of the present disclosure may be realized and attained by the structure particularly pointed out in the written description and claims hereof as well as the appended drawings.

To achieve these objects and other advantages and in accordance with the purpose of the present disclosure, as embodied and broadly described herein, an electroluminescent display device has a plurality of pixels. Each pixel includes a driving transistor having a gate connected to a first node, a source connected to a third node, and a drain connected to a fourth node, the driving transistor generating pixel current corresponding to a data voltage when a high-level source voltage is applied to the third node, an internal compensator comprising a first capacitor connected between the first node and a second node, and a second capacitor connected between the second node and an input terminal for the high-level source voltage, the internal compensator controlling a threshold voltage of the driving transistor with reference to a first scan signal, a second scan signal opposite to the first scan signal in phase, a third scan signal lagging the first scan signal in phase, a fourth scan signal leading the first scan signal in phase, and an emission signal, and a light emitting element connected between a fifth node to be connected to the fourth node and an input terminal for a low-level source voltage.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate aspect(s) of the present disclosure and along with the description serve to explain the principle of the present disclosure.

In the drawings.

DETAILED DESCRIPTION

Figure 1:
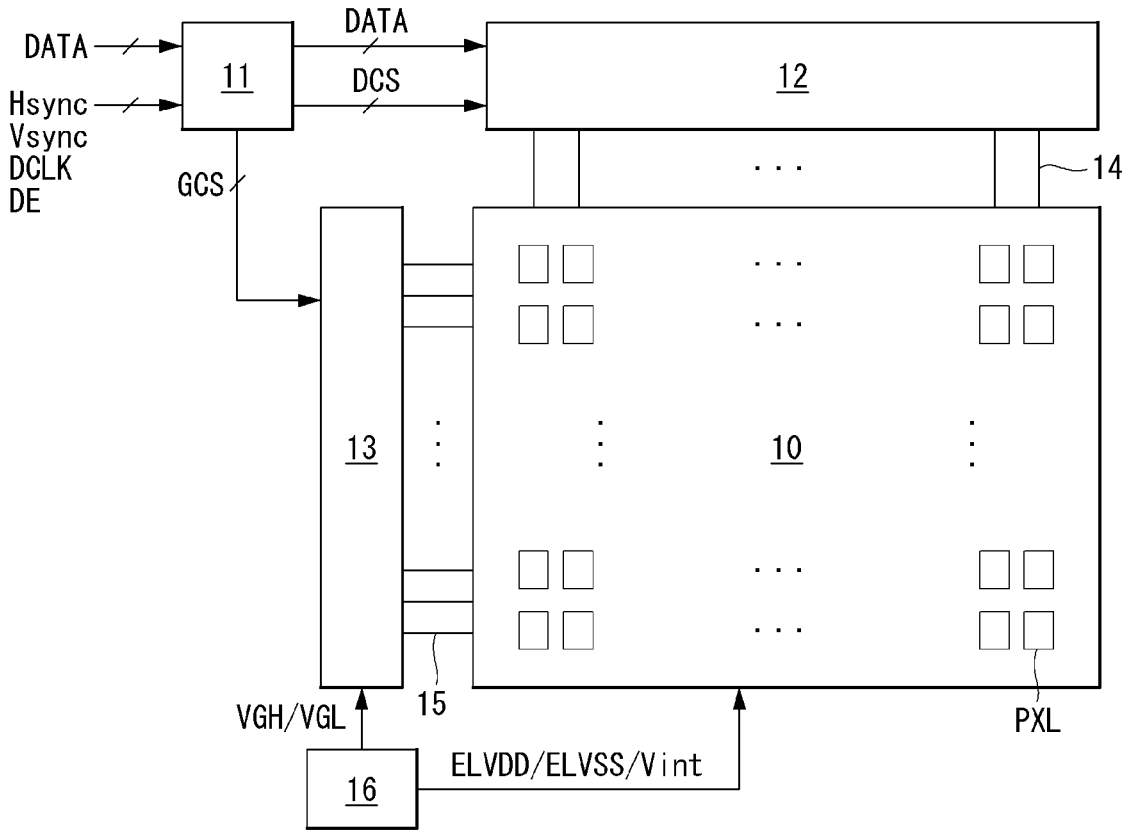
FIG. 1 is a block diagram illustrating an electroluminescent display device according to an exemplary aspect of the present disclosure.

Hereinafter, aspects of the present disclosure will be described in detail with reference to the accompanying drawings. Throughout the disclosure, the same reference numerals designate substantially the same constituent elements. In describing the present disclosure, a detailed description will be omitted when a specific description of publicly known technologies associated with the contents of the present disclosure is judged to obscure understanding of the contents of the present disclosure.

Each of a pixel circuit and a gate driving circuit in an electroluminescent display device may include at least one of an N-channel transistor (NMOS) or a P-channel transistor (PMOS). Such a transistor is a 3-electrode element including a gate, a source, and a drain. The source is an electrode for supplying carriers to the transistor. Within the transistor, carriers begin to flow from the source. The drain is an electrode through which carriers migrate outwards from the transistor. Carriers flow from the source to the drain in the transistor. In an n-channel transistor, carriers are electrons and, as such, a source voltage is lower than a drain voltage in order to enable electrons to flow from the source to the drain. Current flows from the drain to the source in the n-channel transistor. On the other hand, in a p-channel transistor, carriers are holes and, as such, a source voltage is higher than a drain voltage in order to enable holes to flow from the source to the drain. Current flows from the source to the drain in the p-channel transistor because holes flow from the source to the drain. Here, it should be noted that the source and drain of such a transistor are not fixed. For example, the source and the drain may be interchanged with each other in accordance with voltages applied thereto. As such, the present disclosure is not limited to the source and the drain of a transistor. In the following description, accordingly, the source and the drain of a transistor are referred to as a "first electrode" and a "second electrode".

A scan signal (or a gate signal) applied to each pixel swings between a gate-on voltage and a gate-off voltage. The gate-on voltage is set to a voltage higher than a threshold voltage of a transistor in the pixel, and the gate-off voltage is set to a voltage lower than the threshold voltage of the transistor. The transistor turns on in response to the gate-on voltage, and turns off in response to the gate-off voltage. In an N-channel transistor, the gate-on voltage may be a gate-high voltage VGH, and the gate-off voltage may be a gate-low voltage VGL. In a P-channel transistor, the gate-on voltage may be the gate-low voltage VGL, and the gate-off voltage may be the gate-high voltage VGH.

Each pixel of an electroluminescent display device includes a light emitting element, and a driving element configured to generate pixel current in accordance with a gate-source voltage thereof, thereby driving the light emitting element. The light emitting element includes an anode, a cathode, and an organic compound layer formed between the anode and the cathode. The organic compound layer includes a hole injection layer HIL, a hole transport layer HTL, an emission layer EML, an electron transport layer ETL, and an electron injection layer EIL, without being limited thereto. When pixel current flows in the light emitting element, holes passing through the hole transport layer HTL and electrons passing through the electron transport layer ETL migrate to the emission layer EML and, as such, excitons are produced. As a result, the emission layer EML generates visible light.

The driving element may be embodied as a transistor such as a metal oxide semiconductor field effect transistor (MOSFET). Electrical characteristics (for example, threshold voltages) of driving transistors in pixels should be uniform among the pixels. However, such electrical characteristics may be different among the pixels due to process deviation and deviation in element characteristics. Furthermore, such electrical characteristics may vary with passage of the driving time of the display, and variation degrees thereof in pixels may be different. In order to compensate for such deviation of electrical characteristics of the driving transistors, an internal compensation method may be applied to the electroluminescent display device. In accordance with the internal compensation method, a compensator is included in the pixel circuit in order to prevent variation in electrical characteristics of the driving transistor from influencing pixel current.

Recently, attempts to embody a part of transistors included in a pixel circuit in an electroluminescent display device as an oxide transistor have increased. In such an oxide transistor, oxide, that is, an oxide produced through combination of indium (In), gallium (Ga), zinc (Zn) and oxygen (O), and referred to as "IGZO", is used in place of polysilicon.

Such an oxide transistor has an advantage in that, although the oxide transistor exhibits lower electron mobility than a low-temperature polysilicon (hereinafter referred to as "LTPS") transistor, the oxide transistor exhibits higher electron mobility than an amorphous silicon transistor by 10 times or more. In addition, the oxide transistor has an advantage in that the manufacturing costs thereof are considerably lower than those of the LTPS transistor, even though the manufacturing costs thereof are higher than those of the amorphous silicon transistor. Furthermore, since the manufacturing process for the oxide transistor is similar to that of the amorphous silicon transistor, existing equipment may be utilized and, as such, the oxide transistor has an advantage of high efficiency. In particular, since off-current of the oxide transistor is low, the oxide transistor has an advantage in that, when the oxide transistor is driven at low speed such that an off-time thereof is relatively long, high driving stability and high reliability may be achieved. Accordingly, such an oxide transistor may be applied to a large-size liquid crystal display device requiring high resolution and low-power driving or an organic light emitting diode (OLED) TV in which obtaining a desired screen size using an LTPS process is impossible.

Figure 2:
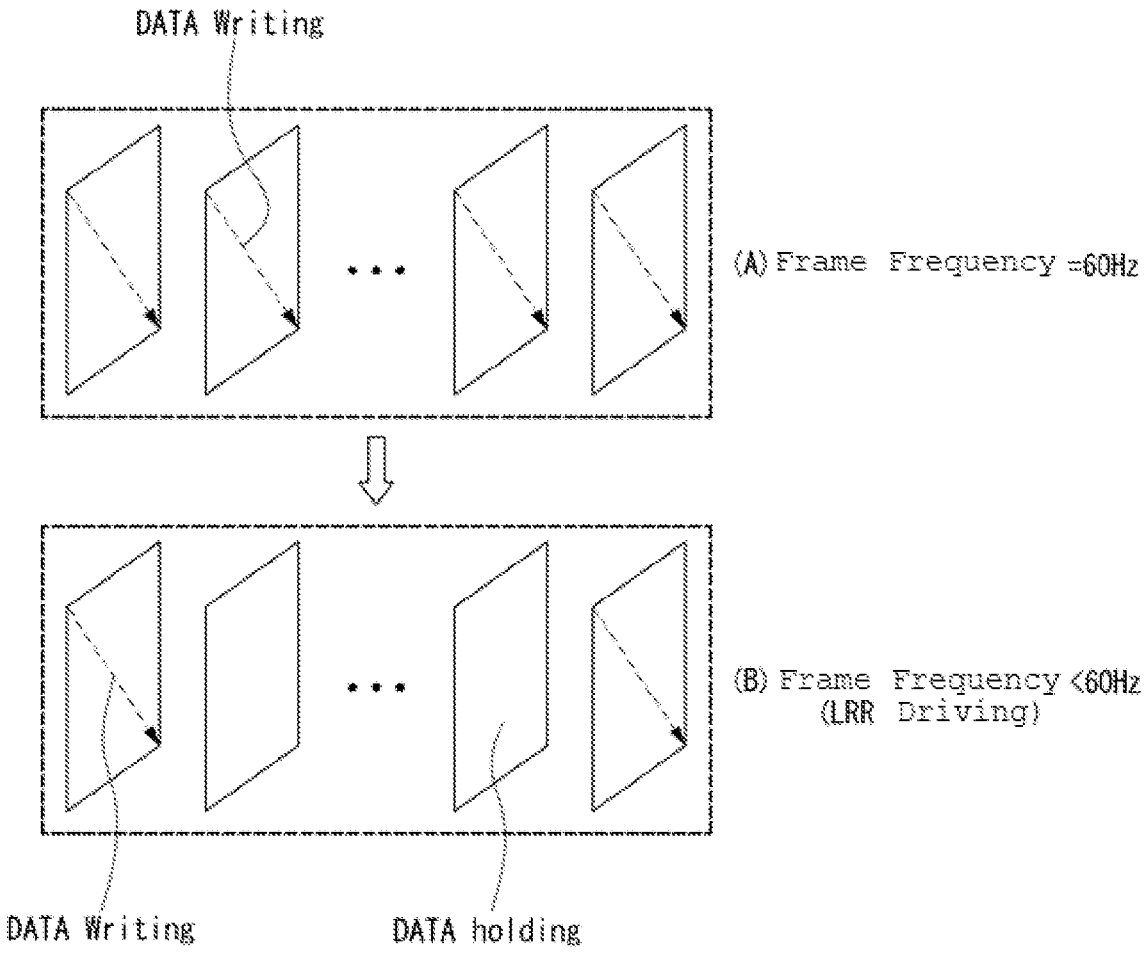
FIG. 2 illustrates a condition in which the electroluminescent display device of FIG. 1 performs low refresh rate (LRR) driving (or low-speed driving)

FIG. 1 is a block diagram illustrating an electroluminescent display device according to an exemplary aspect of the present disclosure. FIG. 2 illustrates a condition in which the electroluminescent display device of FIG. 1 performs low refresh rate (LRR) driving (or low-speed driving).

Referring to FIG. 1, the electroluminescent display device according to the exemplary aspect may include a display panel 10, a timing controller 11, a data driving circuit 12, a gate driving circuit 13, and a power circuit 16. The timing controller 11, the data driving circuit 12, and the power circuit 16 may be completely or partially integrated in a driver integrated circuit.

A plurality of data lines 14 extending in a column direction (or a vertical direction) and a plurality of gate lines 15 extending in a row direction (or a horizontal direction) intersect each other on a screen of the display panel 10 expressing an input image. Pixels PXL are disposed at respective intersection areas in a matrix and, as such, form a pixel array.

Each gate line 15 may include two or more scan lines for supplying two or more scan signals adapted to apply, to corresponding ones of the pixels PXL, a data voltage supplied to each data line 14 and an initialization voltage supplied to an initialization voltage line, respectively, an emission line for supplying an emission signal adapted to enable light emission of the corresponding pixels PXL, etc.

The display panel 10 may further include a first power line for supplying a high-level source voltage ELVDD to the pixels PXL, a second power line for supplying a low-level source voltage ELVSS to the pixels PXL, and the initialization voltage line which supplies an initialization voltage Vint adapted to initialize pixel circuits of the pixel PXL. The first and second power lines and the initialization voltage line are connected to the power circuit 16. The second power line may be formed in the form of a transparent electrode covering a plurality of pixels PXL.

Touch sensors may be disposed on the pixel array of the display panel 10. Touch input may be sensed using separate touch sensors or may be sensed through the pixels PXL. The touch sensors may be embodied as touch sensors disposed on the screen of the display panel 10 in an on-cell type or in an add-on type, or touch sensors built in the pixel array in an in-cell type.

Each of the pixels PXL disposed on the same horizontal line in the pixel array is connected to one of the data lines 14 and one or at least two of the gate lines 15 and, as such, the pixels PXL form a pixel line. Each pixel PXL is electrically connected to the corresponding data line 14 and the initialization voltage line in response to a scan signal and an emission signal applied thereto through the corresponding gate line 15, thereby receiving a data voltage or an initialization voltage Vint. Accordingly, each pixel PXL drives a light emitting element to emit light by pixel current corresponding to the data voltage. The pixels PXL disposed on the same pixel line operate simultaneously in accordance with a scan signal and an emission signal applied through the same gate line 15.

One pixel unit may be constituted by three sub-pixels including a red sub-pixel, a green sub-pixel, and a blue sub-pixel, or four sub-pixels including a red sub-pixel, a green sub-pixel, a blue sub-pixel, and a white sub-pixel, without being limited thereto. Each sub-pixel may be embodied as a pixel circuit including a compensator. In the following description, "pixel" means "sub-pixel".

Each pixel PXL may receive a high-level source voltage ELVDD, an initialization voltage Vint, and a low-level source voltage ELVSS from the power circuit 16, and may include a driving transistor, a light emitting element, and an internal compensator. The internal compensator may be constituted by a plurality of switching transistors and at least one capacitor, as in the case of FIG. 3 which will be described later.

The timing controller 11 supplies image data DATA sent from an external host system (not shown) to the data driving circuit 12. The timing controller 11 receives, from the host system, timing signals such as a vertical synchronization signal Vsync, a horizontal synchronization signal Hsync, a data enable signal DE, and a dot clock DCLK, and, as such, generates control signals adapted to control operation timings of the data driving circuit 12 and the gate driving circuit 13. The control signals include a gate timing control signal GCS adapted to control operation timing of the gate driving circuit 13 and a data timing control signal DCS adapted to control operation timing of the data driving circuit 12.

The data driving circuit 12 samples and latches digital image data DATA input thereto from the timing controller 11, based on the data timing control signal DCS, thereby changing the digital image data DATA into parallel data. Subsequently, the data driving circuit 12 converts the parallel data into analog data voltages through a digital-analog converter (hereinafter referred to as "DAC") in accordance with a gamma reference voltage, and supplies the data voltages to the pixels PXL via output channels and the data lines 14, respectively. Each data voltage may be a value corresponding to a grayscale to be expressed by a corresponding one of the pixels PXL. The data driving circuit 12 may be constituted by a plurality of driver integrated circuits.

The data driving circuit 12 may include a shift register, a latch, a level shifter, a DAC, and a buffer. The shift register shifts a clock input thereto from the timing controller 11, thereby sequentially outputting clocks for sampling. The latch samples and latches digital image data at timings of sampling clocks sequentially input thereto from the shift register, and simultaneously outputs all sampled pixel data. The level shifter shifts voltages of pixel data input thereto from the latch to be within an input voltage range of the DAC. The DAC converts the pixel data received from the level shifter into data voltages, and then supplies the data voltages to the data lines 14 via the buffer.

The gate driving circuit 13 generates a scan signal and an emission signal based on the gate control signal GCS. In this case, the gate driving circuit 13 generates the scan signal and the emission signal in a row sequential manner in an active period, and then sequentially applies the scan signal and the emission signal to the gate lines 15 connected to respective pixel lines. A particular scan signal of each gate line 15 is synchronized with timing of data voltage supply to the data lines 14. The scan signal and the emission signal swing between a gate-on voltage and a gate-off voltage.

The gate driving circuit 13 may be constituted by a plurality of gate drive integrated circuits each including a shift register, a level shifter for converting an output signal from the shift register into a signal having a swing width suitable for thin film transistor (TFT) driving of pixels, an output buffer, etc. Alternatively, the gate driving circuit 13 may be directly formed at a lower substrate of the display panel 10 in a gate-drive IC in panel (GIP) manner. When the gate driving circuit 13 is of a GIP type, the level shifter may be mounted on a printed circuit board (PCB), and the shift register may be formed on the lower substrate of the display panel 10.

The power circuit 16 adjusts a DC input voltage supplied from the host system using a DC-DC converter, thereby generating a gate-on voltage VGH, a gate-off voltage VGL, etc. required for operation of the data driving circuit 12 and the gate driving circuit 13. The power circuit 16 also generates a high-level source voltage ELVDD, an initialization voltage Vint, and a low-level source voltage ELVSS required for driving of the pixel array. The initialization voltage Vint may include a first initialization voltage and a second initialization voltage higher than the first initialization voltage. The second initialization voltage is needed for aging operation to alleviate hysteresis characteristics of the driving transistor.

The host system may be an application processor (AP) in a mobile appliance, a wearable appliance, a virtual/augmented reality appliance, or the like. Otherwise, the host system may be a main board in a television system, a set-top box, a navigation system, a personal computer, a home theater system, or the like. Of course, aspects of the present disclosure are not limited to the above-described conditions.

FIG. 2 illustrates a condition in which the electroluminescent display device of FIG. 1 performs low refresh rate (LRR) driving (or low-speed driving).

Referring to FIG. 2, the electroluminescent display device according to the exemplary aspect may adopt LRR driving in order to reduce power consumption. LRR driving illustrated in FIG. 2(B) reduces the number of image frames in which data voltages are written, as compared to 60 Hz driving illustrated in FIG. 2(A). In 60 Hz driving, 60 image frames are reproduced per second. Data voltage writing operation is carried out for all of the 60 image frames. On the other hand, in LRR driving, data voltage writing operation is carried out only for a part of the 60 image frames. In LRR driving, in each of the remaining image frames, data voltages written in a previous image frame are maintained (held). In other words, output operations of the data driving circuit 12 and the gate driving circuit 13 are stopped for the remaining image frames and, as such, there is an effect of reducing power consumption. LRR driving may be applied to a still image or a moving image exhibiting image variation, and a data voltage update period therein may be longer than that of 60 Hz driving. In a pixel circuit, accordingly, the time for which the gate-source voltage of a driving transistor is maintained is longer in LRR driving than in 60 Hz driving. In LRR driving, it is necessary to maintain the gate-source voltage of the driving transistor for a desired time. To this end, switching transistors may be directly/indirectly connected to the gate of the driving transistor be embodied as oxide transistors exhibiting excellent off characteristics. Meanwhile, 60 Hz driving and LRR driving may be selectively applied to the exemplary aspect in accordance with characteristics of an input image. When a first image frame and a second image frame, in which the data voltage is written in the pixels, are present, a plurality of third image frames, in which the data voltage written in the first image frame is maintained, is disposed between the first image frame and the second image frame.

Figure 3:
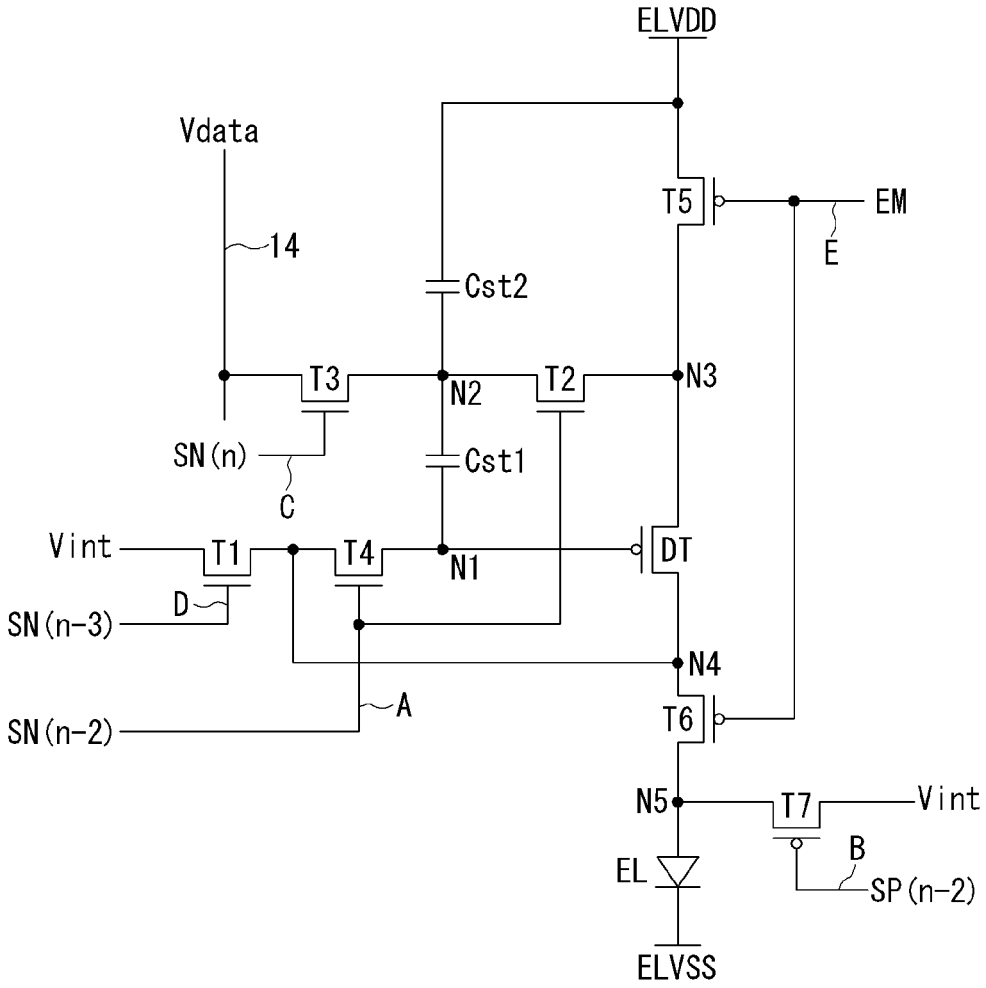
FIG. 3 is an equivalent circuit diagram of one pixel included in the electroluminescent display device of FIG. 1.
Figure 4:
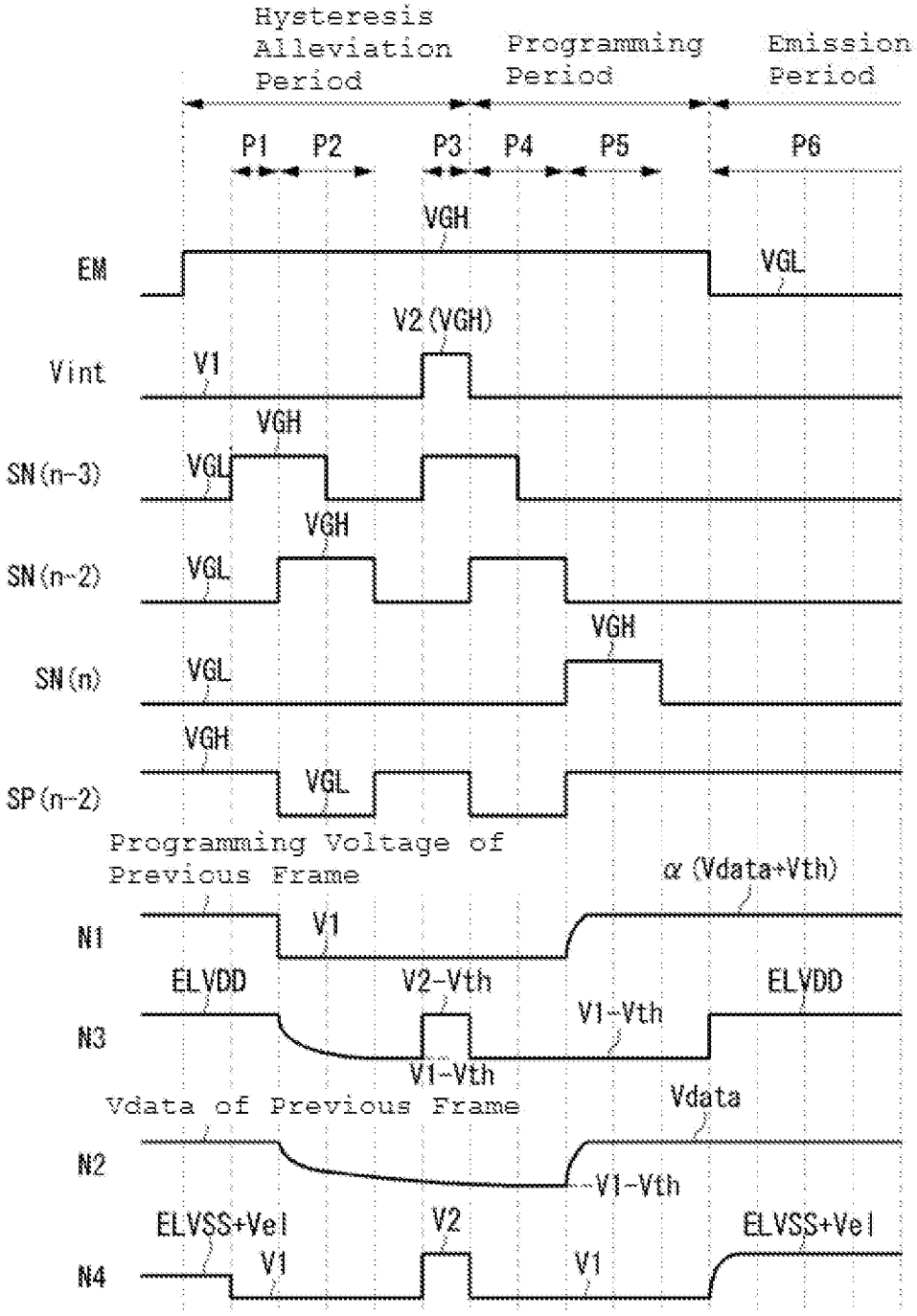
FIG. 4 is a driving waveform diagram of a pixel circuit shown in FIG. 3.

FIG. 3 is an equivalent circuit diagram of one pixel included in the electroluminescent display device of FIG. 1. FIG. 4 is a driving waveform diagram of a pixel circuit shown in FIG. 3. In the following description, a first electrode of a transistor may be one of a source and a drain, and a second electrode of the transistor may be the other of the source and the drain.

Referring to FIG. 3, a pixel circuit of the pixel is connected to a data line 14, a first scan line A, a second scan line B, a third scan line C, a fourth scan line D, and an emission line E. The pixel circuit receives a data voltage Vdata from the data line 14, receives a first scan signal SN(n-2) from the first scan line A, receives a second scan signal SP(n-2) from the second scan line B, receives a third scan signal SN(n) from the third scan line C, receives a fourth scan signal SN(n-3) from the fourth scan line D, and receives an emission signal EM from the emission line E. The first scan signal SN(n-2) and the second scan signal SP(n-2) have opposite phases. The third scan signal SN(n) has a phase lagging the phase of the first scan signal SN(n-2). The fourth scan signal SN(n-3) has a phase leading the phase of the first scan signal SN(n-2).

Referring to FIGS. 3 and 4, the pixel circuit may include a driving transistor DT, a light emitting element EL, and an internal compensator.

The driving transistor DT generates pixel current enabling the light emitting element EL to emit light in conformity with a data voltage Vdata. The driving transistor DT is connected, at the first electrode thereof, to a third node N3 while being connected, at the second electrode thereof, to a fourth node N4. The gate of the driving transistor DT is connected to a first node N1.

The light emitting element EL includes an anode connected to the fifth node N5, a cathode connected to an input terminal for a low-level source voltage ELVSS, and an emission layer disposed between the anode and the cathode. The light emitting element EL may be embodied as an organic light emitting diode including an organic emission layer or an inorganic light emitting diode including an inorganic emission layer.

The internal compensator is adapted not only to compensate for a threshold voltage of the driving transistor DT, but also to alleviate hysteresis characteristics of the driving transistor DT. The internal compensator may be constituted by seven switching transistors T1 to T7, and two capacitors Cst1 and Cst2. In this case, at least a part of the switching transistors T1 to T7 may be constituted by an oxide transistor.

The internal compensator includes a first capacitor Cst1 connected between the first node N1 and a second node N2, and a second capacitor Cst2 connected between the second node N2 and an input terminal for a high-level source voltage ELVDD. The internal compensator functions to reflect the threshold voltage of the driving transistor DT in the gate-source voltage of the driving transistor DT in an emission period P6 following a programming period P4-P5 by controlling voltages of the first to fifth nodes N1, N2, N3, N4 and N5 in accordance with operation of a plurality of transistors in an aging period P3 and the programming period P4-P5 set with reference to the first scan signal SN(n-2), the second scan signal SP(n-2) opposite to the first scan signal SN(n-2) in phase, the third scan signal SN(n) lagging the first scan signal SN(n-2) in phase, the fourth scan signal SN(n-3) leading the first scan signal SN(n-2) in phase, and the emission signal EM. When the threshold voltage of the driving transistor DT is reflected in the gate-source voltage of the driving transistor DT in the emission period P6, pixel current flowing through the driving transistor DT is not substantially influenced by a variation in the threshold voltage of the driving transistor DT. As such, threshold voltage variation of the driving transistor DT is compensated for within the pixel.

The programming period P4-P5 includes an initialization period P4 and a data writing period P5 following the initialization period P4. The internal compensator may control operations of the switching transistors during the initialization period P4 such that a first initialization voltage V1 is applied to the first, fourth and fifth nodes N1, N4 and N5, and may control operations of the switching transistors during the data writing period P5 such that the data voltage Vdata is applied to the second node N2.

The first switching transistor T1 is adapted to apply an initialization voltage Vint to the fourth node N4. One of the first and second electrodes in the first switching transistor T1 is connected to an input terminal for the initialization voltage Vint, and the other of the first and second electrodes is connected to the fourth node N4. The gate of the first switching transistor T1 is connected to the fourth scan line D to receive the fourth scan signal SN(n-3).

The second switching transistor T2 is adapted to apply a threshold voltage of the driving transistor DT to the second node N2. One of the first and second electrodes in the second switching transistor T2 is connected to the second node N2, and the other of the first and second electrodes is connected to the third node N3. The gate of the second switching transistor T2 is connected to the first scan line A to receive the first scan signal SN(n-2).

The third switching transistor T3 is adapted to supply the data voltage Vdata of the data line 14 to the second node N2. One of the first and second electrodes in the third switching transistor T3 is connected to the data line 14, and the other of the first and second electrodes is connected to the second node N2. The gate of the third switching transistor T3 is connected to the third scan line C to receive the third scan signal SN(n).

The fourth switching transistor T4 is adapted to supply the initialization voltage Vint to the gate electrode of the driving transistor DT, that is, the first node N1. One of the first and second electrodes in the fourth switching transistor T4 is connected to the fourth node N4, and the other of the first and second electrodes is connected to the first node N1. The gate of the fourth switching transistor T4 is connected to the first scan line A to receive the first scan signal SN(n-2).

Each of the fifth switching transistor T5 and the sixth switching transistor T6 is adapted to control light emission of the light emitting element EL. One of the first and second electrodes in the fifth switching transistor T5 is connected to an input terminal for the high-level source voltage ELVDD, and the other of the first and second electrodes is connected to the third node N3. The gate of the fifth switching transistor T5 is connected to the emission line E to receive an emission signal EM. One of the first and second electrodes in the sixth switching transistor T6 is connected to the fourth node N4, and the other of the first and second electrodes is connected to the fifth node N5. The gate of the sixth switching transistor T6 is connected to the emission line E to receive the emission signal EM.

The seventh switching transistor T7 is adapted to supply the initialization voltage Vint to the anode of the light emitting element EL. One of the first and second electrodes in the seventh switching transistor T7 is connected to the anode of the light emitting element EL, and the other of the first and second electrodes is connected to the input terminal for the initialization voltage Vint. The gate of the seventh switching transistor T7 is connected to the second scan line B to receive the second scan signal SP(n-2).

The first storage capacitor Cst1 is connected between the first node N1 and the second node N2 to store the threshold voltage of the driving transistor DT in the initialization period P4.

The second storage capacitor Cst2 functions to store the data voltage Vdata in the data writing period P5. One of the first and second electrodes in the second storage capacitor Cst2 is connected to the second node N2, and the other of the first and second electrodes is connected to the input terminal for the high-level source voltage ELVDD.

The pixel current flowing through the driving transistor DT is determined by the gate-source voltage of the driving transistor DT, that is, the voltages of the first and third nodes N1 and N3, in an emission period. In the emission period P6, the voltage of the third node N3 is fixed to the high-level source voltage ELVDD, but the voltage of the first node N1 is influenced by off characteristics of the first and fourth switching transistors T1 and T4. This is because the first node N1 is in a floating state due to OFF states of the first and fourth switching transistors T1 and T4 in the emission period P6. Accordingly, the first and fourth switching transistors T1 and T4 may be embodied as an N-type oxide transistor having excellent off characteristics (that is, low off-current). In addition, the second and third switching transistors T2 and T3, which are maintained in an OFF state in the emission period P6, may be embodied as an N-type oxide transistor having excellent off characteristics (that is, low off-current) because the second and third switching transistors T2 and T3 may have an influence on the voltage of the first node N1 due to coupling actions thereof through the first storage capacitor Cst1. Meanwhile, the driving transistor DT may be embodied as a P-type low-temperature polysilicon (LTPS) transistor having excellent electron mobility because the driving transistor DT generates pixel current. Similarly, the fifth to seventh switching transistors T5 to T7 may be embodied as a P-type LTPS transistor. In a P-channel transistor, the gate-on voltage turning on the transistor is a gate-low voltage VGL, and the gate-off voltage turning off the transistor is a gate-high voltage VGH. In an N-channel transistor, the gate-on voltage turning on the transistor is a gate-high voltage VGH, and the gate-off voltage turning off the transistor is a gate-low voltage VGL.

The pixel current flowing through the driving transistor DT during the emission period P6 is determined by the gate-source voltage of the driving transistor DT set in the programming period P4-P5, that is, the voltages of the first and third nodes N1 and N3. Since the threshold voltage of the driving transistor DT has been reflected in the gate-source voltage of the driving transistor DT, it may be possible to obtain desired pixel current irrespective of a variation in the threshold voltage of the driving transistor DT. To this end, the gate-source voltage of the driving transistor DT should be correctly set in the programming step in order to achieve a desired threshold voltage compensation effect.

Since the gate-source voltage of the driving transistor DT is influenced by hysteresis characteristics of the driving transistor DT, the internal compensator applies relatively strong on-bias to the driving transistor DT using the aging period P3 preceding the programming period P4-P5, thereby alleviating hysteresis characteristics of the driving transistor DT prior to programming.

This will be described in detail. The internal compensator controls the driving transistor DT to be a first level including a threshold voltage within the programming period P4-P5, based on a first initialization voltage V1 and a data voltage Vdata. In particular, the internal compensator controls the gate-source voltage of the driving transistor DT to be a second level higher than the first level within the aging period P3 preceding the programming period P4-P5, based on a second initialization voltage V2 (VGH) higher than the first initialization voltage V1, thereby alleviating hysteresis characteristics of the driving transistor DT prior to programming. In this case, the driving transistor DT becomes in an on-bias state by a gate-source voltage thereof having the first or second level. The on-bias voltage (that is, the gate-source voltage) of the driving transistor DT is higher in the aging period P3 than in the programming period P4-P5. In other words, an on-channel resistance of the driving transistor DT is smaller in the aging period P3 than in the programming period P4-P5.

In the case of FIG. 4, the hysteresis alleviation period may be embodied to include the aging period P3 alone. In this case, the on-bias voltage (that is, the gate source voltage) of the driving transistor DT in the aging period P3 may be a voltage obtained by deducting a previous frame programming voltage from the second initialization voltage V2 (V2-previous frame programming voltage).

Meanwhile, in the case of FIG. 4, the hysteresis alleviation may be embodied to include both a pre-initialization period P1-P2 and the aging period P3. To this end, the internal compensator may further set the pre-initialization period P1-P2 preceding the aging period P3, and may further control operations of the switching transistors such that the first initialization voltage V1 is applied to the first, fourth and fifth nodes N1, N4 and N5 within the pre-initialization period P1-P2. An aging effect is enhanced in proportion to the on-bias voltage (that is, the gate-source voltage) of the driving transistor DT. When the gate voltage of the driving transistor DT (that is, the voltage of the first node N1) is previously lowered to the first initialization voltage V1 through the pre-initialization period P1-P2, the on-bias voltage (that is, the gate-source voltage) of the driving transistor DT increases, as compared to the case in which entrance to the aging period P3 is immediately carried out without the pre-initialization period P1-P2. That is, a voltage "V2-Vth-V1" is higher than the voltage "V2-previous frame programming voltage". Accordingly, when the pre-initialization period P1-P2 preceding the aging period P3 is further set, there is an advantage in that an aging effect is maximized.

Of course, for further setting of the pre-initialization period P1-P2 preceding the aging period P3, each of the first scan signal SN(n-2), the second scan signal SP(n-2) and the fourth scan signal SN(n-3) may be input at a primary ON-level in the pre-initialization period P1-P2, and may then be input at a secondary ON-level in the programming period P4-P5.

Of course, since the pixel circuit can also be driven without the pre-initialization period P1-P2, each of the first scan signal SN(n-2), the second scan signal SP(n-2) and the fourth scan signal SN(n-3) may be input at an ON-level only once.

FIGS. 5A to 10B are diagrams associated with operations of the pixel in the periods P1 to P6 of FIG. 4. In FIGS. 5A to 10B, P1 and P2 represent a pre-initialization period, P3 represents an aging period, P4 represents an initialization period, P5 is a data writing period, and P6 is an emission period.

Figure 5A:
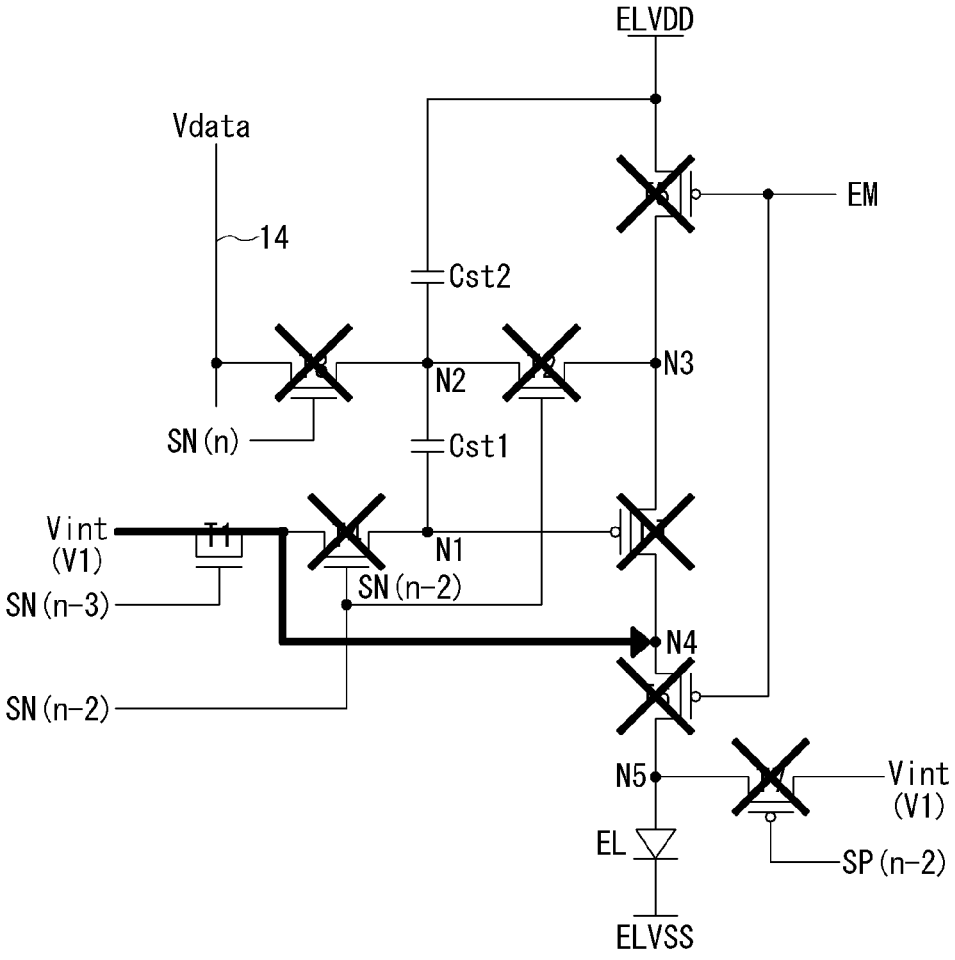
FIGS. 5A and 5B are diagrams associated with operation of each pixel in a period P1 of FIG. 4.
Figure 5B:
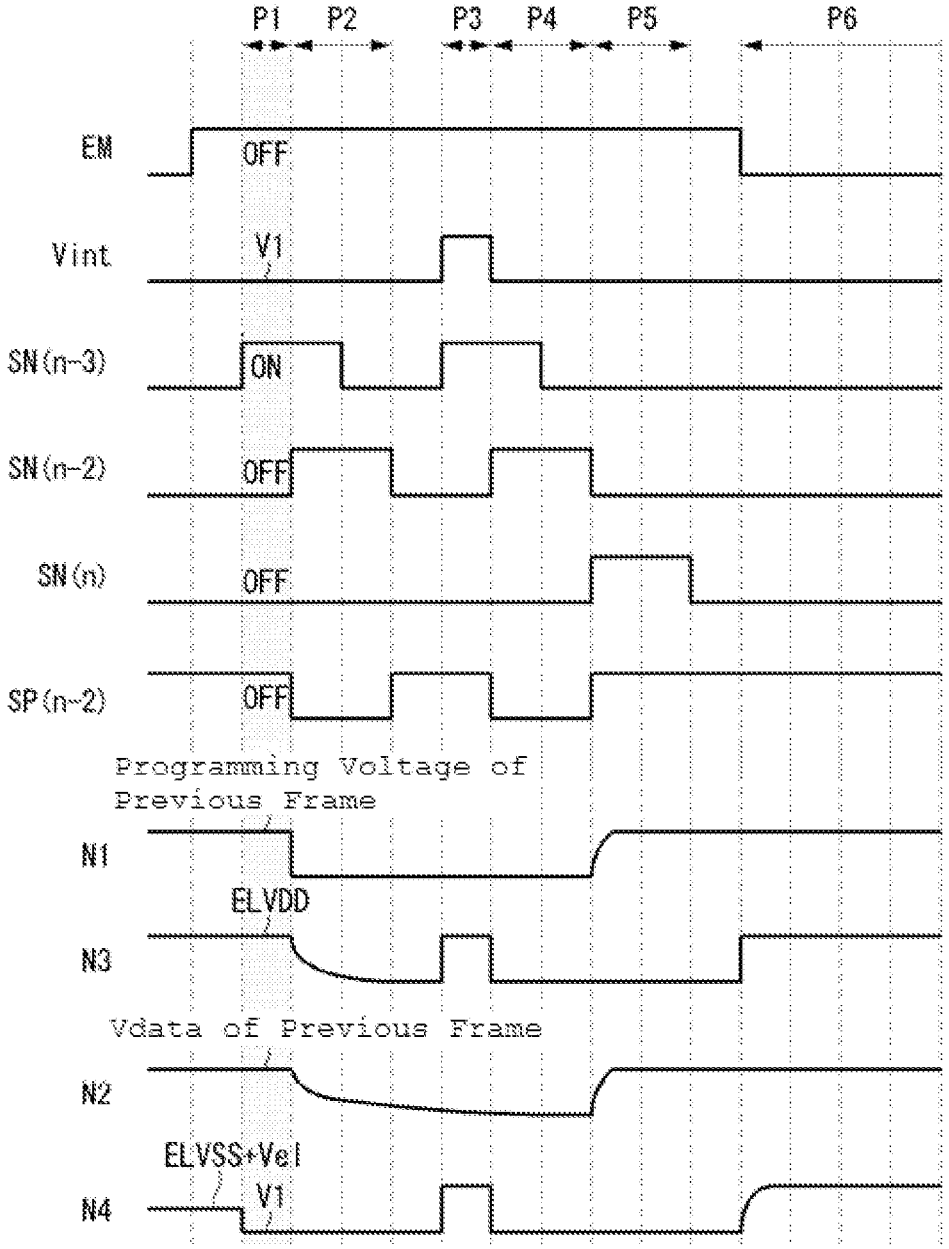

Referring to FIGS. 5A and 5B, in the first period P1, each of the first to third scan signals SN(n-2), SN(n) and SP(n-2), and the emission signal EM is a gate-off voltage, whereas the fourth scan signal SN(n-3) is a gate-on voltage. The first switching transistor T1 turns on, thereby applying the first initialization voltage V1 to the fourth node N4. On the other hand, the second to seventh switching transistors T2 to T7 turn off and, as such, each of the first, second, third, and fifth nodes N1, N2, N3, and N5 is maintained in a previous voltage state thereof, or the voltage state thereof cannot be determined.

Figure 6A:
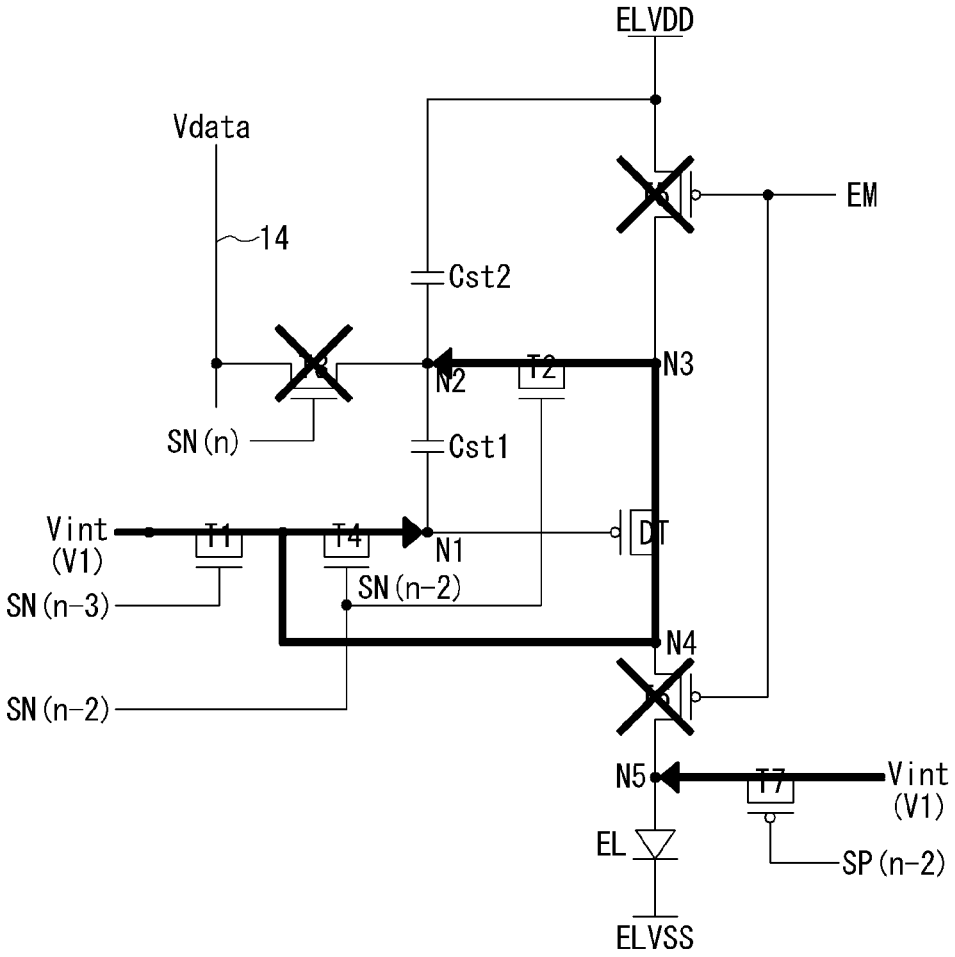
FIGS. 6A and 6B are diagrams associated with operation of each pixel in a period P2 of FIG. 4.
Figure 6B:
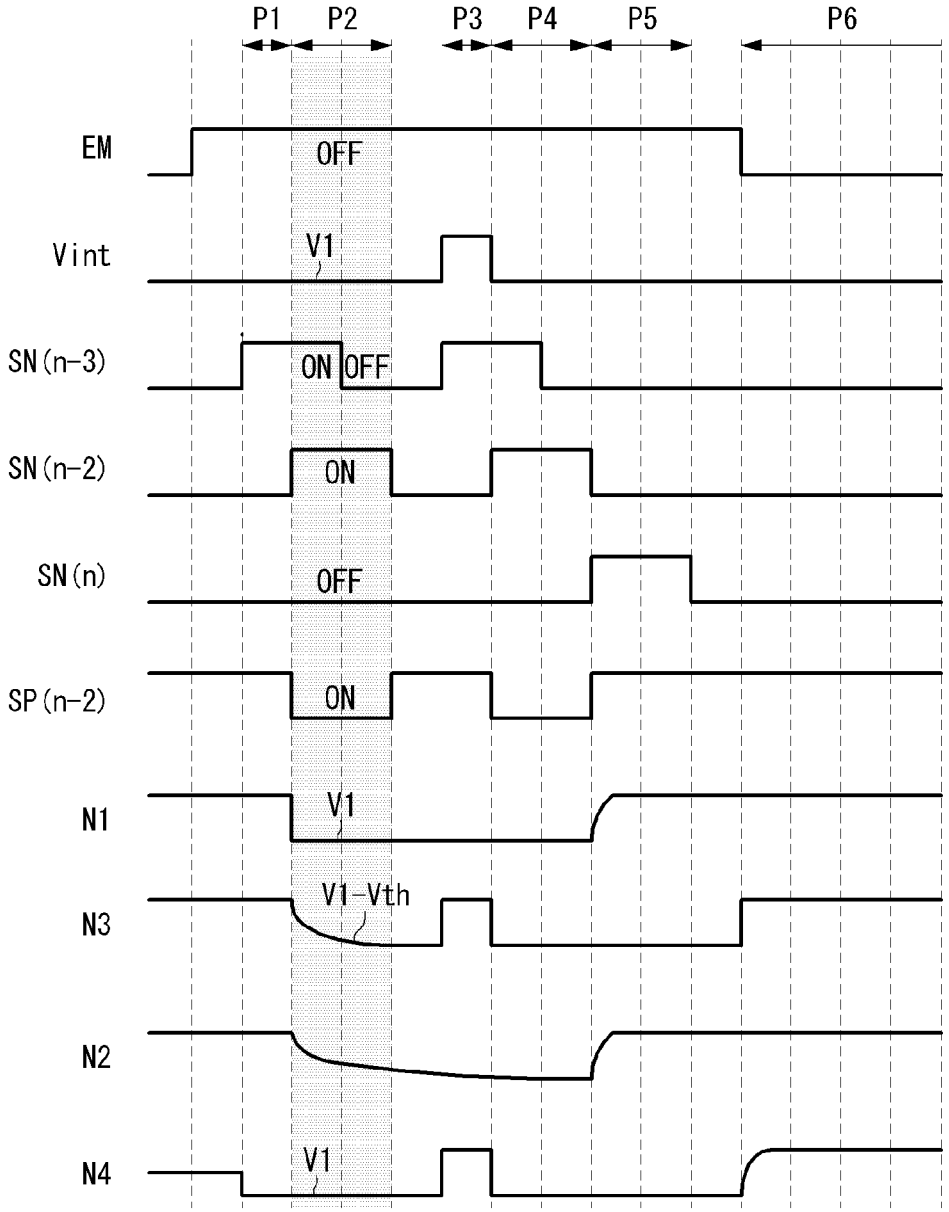

Referring to FIGS. 6A and 6B, in the second period P2, each of the first, second and fourth scan signals SN(n-2), SP(n-2) and SN(n-3) is a gate-on voltage, whereas each of the third scan signal SN(n) and the emission signal EM is a gate-off voltage. The first, second, fourth and seventh switching transistors T1, T2, T4 and T7 turn on by the first, second and fourth scan signals SN(n-2), SP(n-2) and SN(n-3) having the gate-on voltage. Accordingly, the first initialization voltage V1 is supplied to the first node N1 via the first and fourth switching transistors T1 and T4, and current flows through the second to fourth nodes N2, N3 and N4 via the first switching transistor T1 and the driving transistor DT. That is, current flows in a direction of the first switching transistor T1→the driving transistor D→the second switching transistor T2 or in an opposite direction. Accordingly, each voltage of the second node N2 and the third node N3 is lowered from the first initialization voltage V1 by the threshold voltage Vth of the driving transistor DT and, as such, each potential of the second node N2 and the third node N3 rises (or drops) until the driving transistor DT turns off. Accordingly, when the second period P2 ends, the voltage of the first node N1 becomes the first initialization voltage V1, and each voltage of the second and third nodes N2 and N3 becomes a voltage V1-Vth lower than the initialization voltage Vint, that is, the first initialization voltage V1, by the threshold voltage Vth of the driving transistor DT or the vicinity thereof.

Figure 7A:
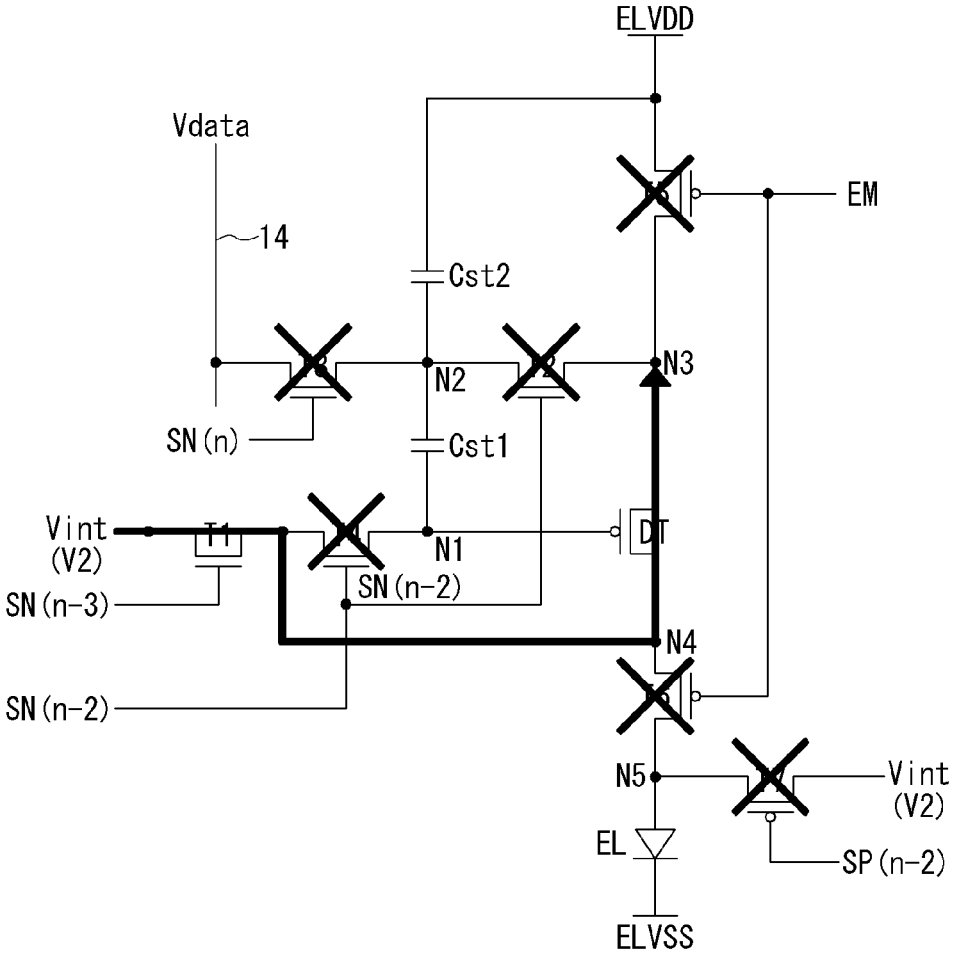
FIGS. 7A and 7B are diagrams associated with operation of each pixel in a period P3 of FIG. 4.
Figure 7B:
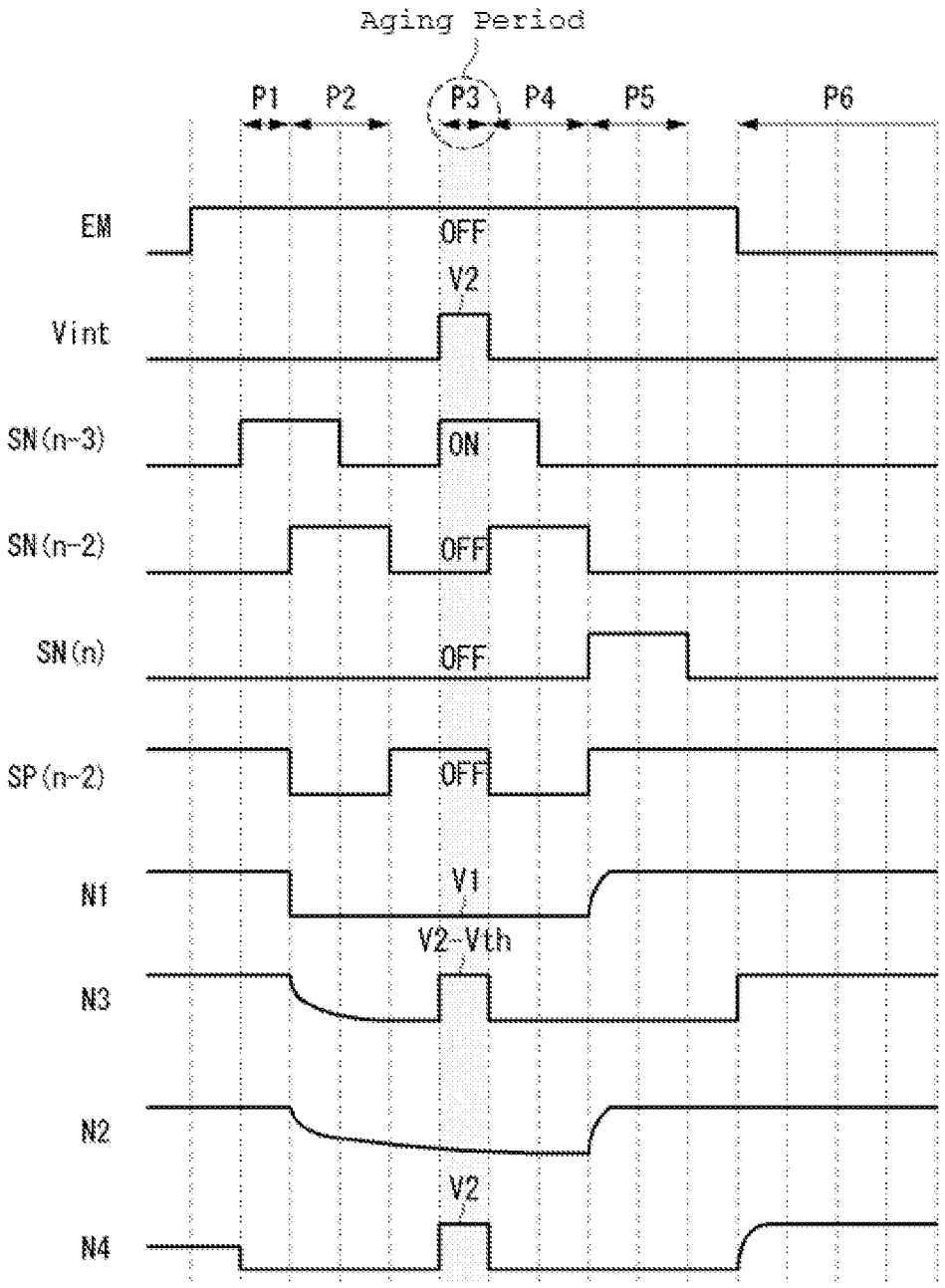

As shown in FIGS. 7A and 7B, in the third period P3, the fourth scan signal SN(n-3) is a gate-on voltage, whereas each of the first to third scan signals SN(n-2), SN(n) and SP(n-20), and the emission signal EM is a gate-off voltage. The driving transistor DT is maintained in an ON state, and the first switching transistor T1 turns on by the fourth scan signal SN(n-3) having the gate-on voltage. Accordingly, the second initialization voltage V2 higher than the first initialization voltage V1 is charged in the fourth node N4, and an initialization voltage V2-Vth higher than the first initialization voltage V1 is charged in the third node N3. The on-bias voltage (gate-source voltage) of the driving transistor DT becomes "V2-Vth-V1". By the on-bias voltage, hysteresis characteristics of the driving transistor DT are alleviated. Meanwhile, all of the second to seventh switching transistors T2 to T7 turn off.

Figure 8A:
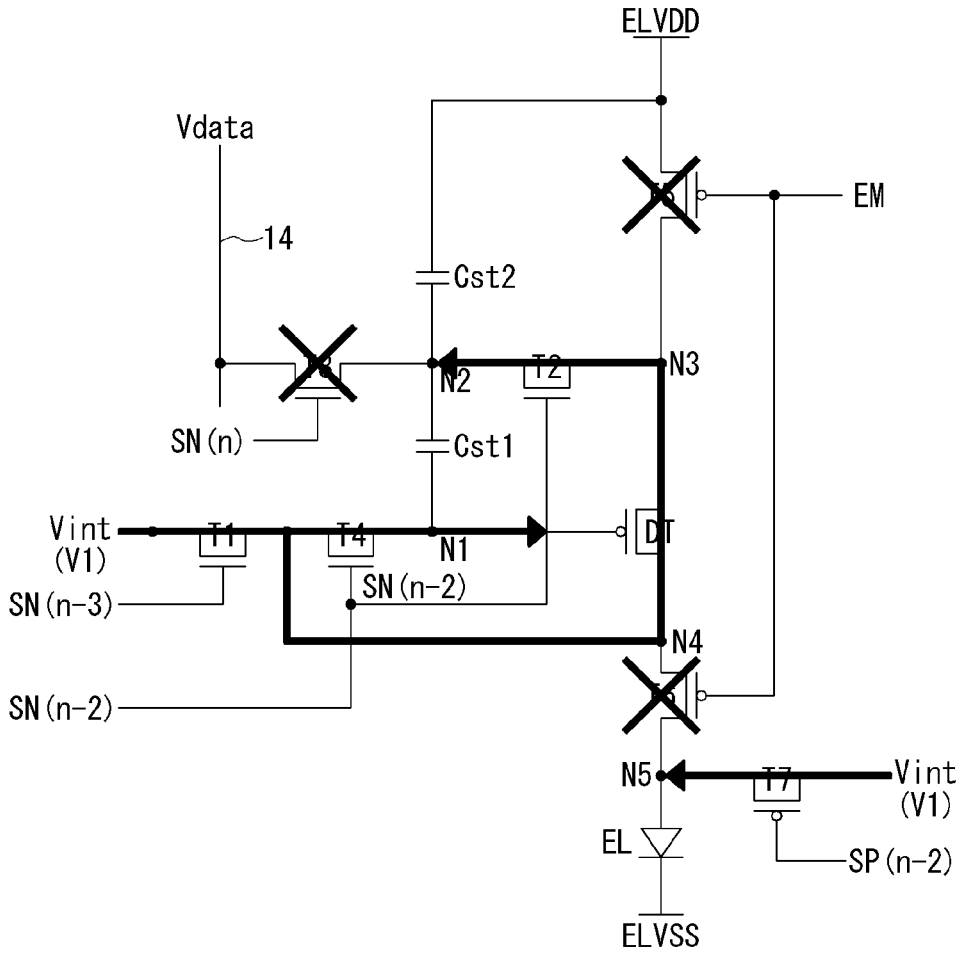
FIGS. 8A and 8B are diagrams associated with operation of each pixel in a period P4 of FIG. 4.
Figure 8B:
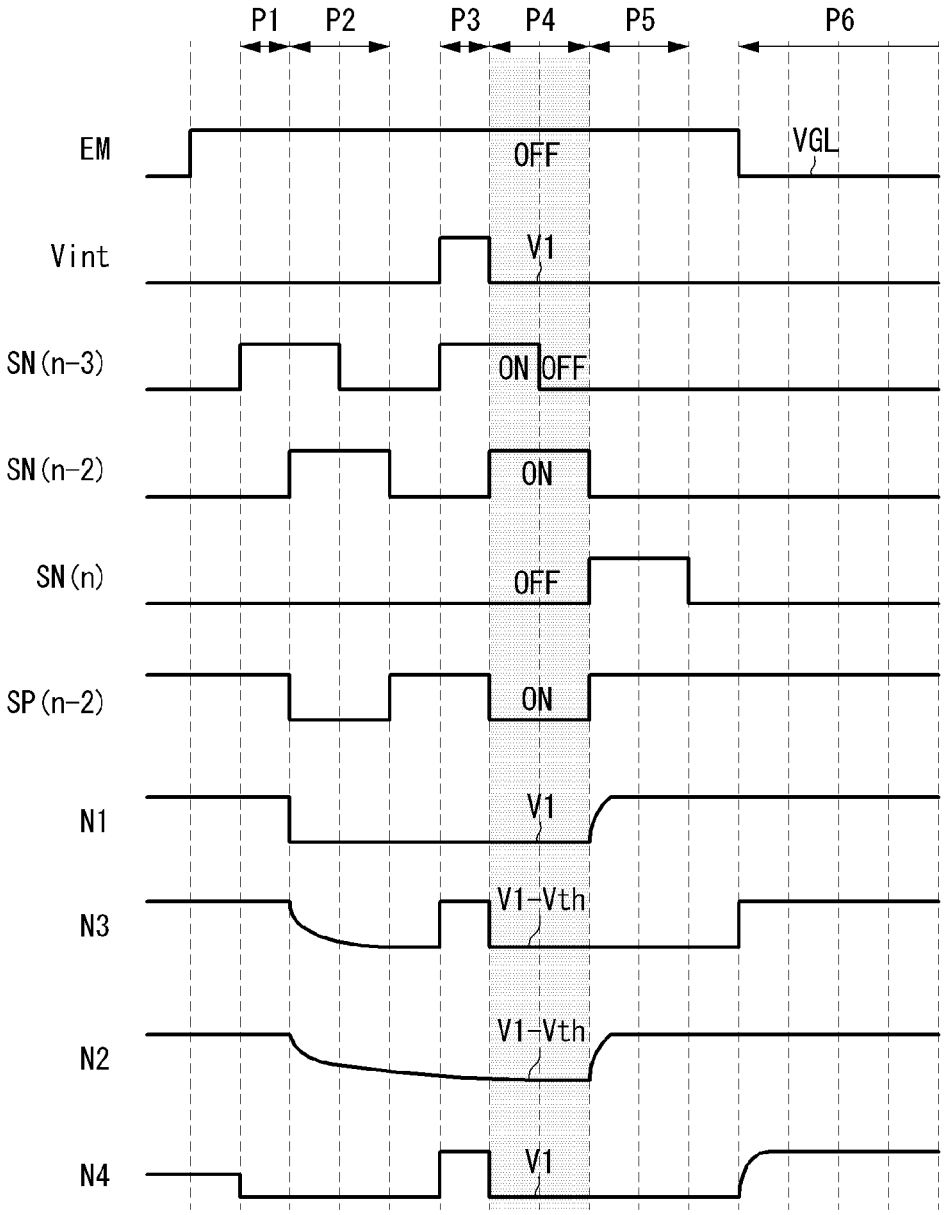

Referring to FIGS. 8A and 8B, in the fourth period P4, each of the first, second and fourth scan signals SN(n-2), SP(n-2) and SN(n-3) is a gate-on voltage, whereas each of the third scan signal SN(n) and the emission signal EM is a gate-off voltage. The first, second, fourth and seventh switching transistors T1, T2, T4 and T7 turn on by the first, second and fourth scan signals SN(n-2), SP(n-2) and SN(n-3) having the gate-on voltage. Accordingly, the first initialization voltage V1 is supplied to the first node N1 via the first and fourth switching transistors T1 and T4, and current flows through the second to fourth nodes N2, N3 and N4 via the first switching transistor T1 and the driving transistor DT. That is, current flows in a direction of the first switching transistor T1→the driving transistor DT→the second switching transistor T2 or in an opposite direction. Accordingly, each voltage of the second node N2 and the third node N3 is lowered from the first initialization voltage V1 by the threshold voltage Vth of the driving transistor DT and, as such, each potential of the second node N2 and the third node N3 rises (or drops) until the driving transistor DT turns off. Accordingly, when the fourth period P4 ends, the voltage of the first node N1 becomes the first initialization voltage V1, and each voltage of the second and third nodes N2 and N3 becomes a voltage V1-Vth lower than the initialization voltage Vint, that is, the first initialization voltage V1, by the threshold voltage Vth of the driving transistor DT or the vicinity thereof. The threshold voltage Vth of the driving transistor DT is stored in the first storage capacitor Cst1.

In the fourth period P4, the potential of the first node N1 immediately becomes the first initialization voltage V1, and the potential difference between the first initialization voltage V1 of the first node N1 and the high-level source voltage ELVDD is divided by the first and second storage capacitors Cst1 and Cst2. The divided potential is immediately formed at the second node N2. Subsequently, the potential of the second node N2 becomes a voltage V1-Vth through reflection of the first initialization voltage V1 and the threshold voltage Vth by current according to the first initialization voltage V1. Accordingly, the time taken for the potential of the second node N2 to be fixed is not long.

Figure 9A:
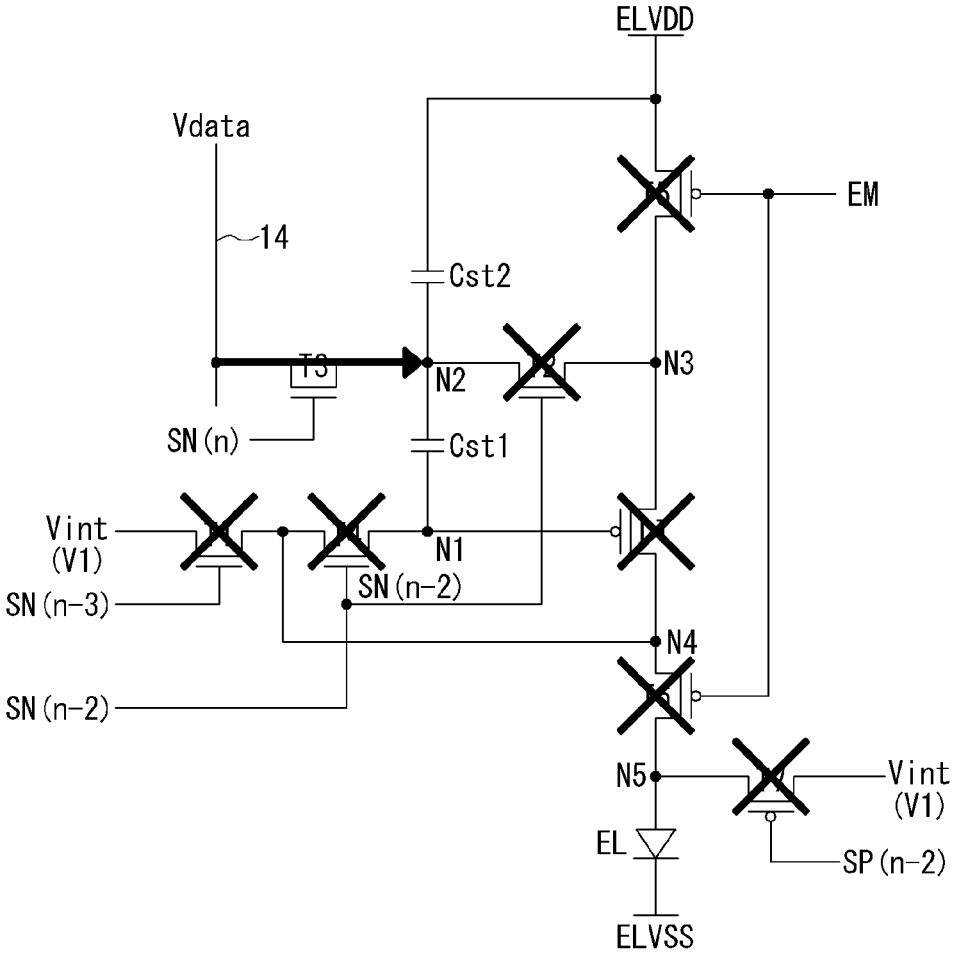
FIGS. 9A and 9B are diagrams associated with operation of each pixel in a period P5 of FIG. 4.
Figure 9B:
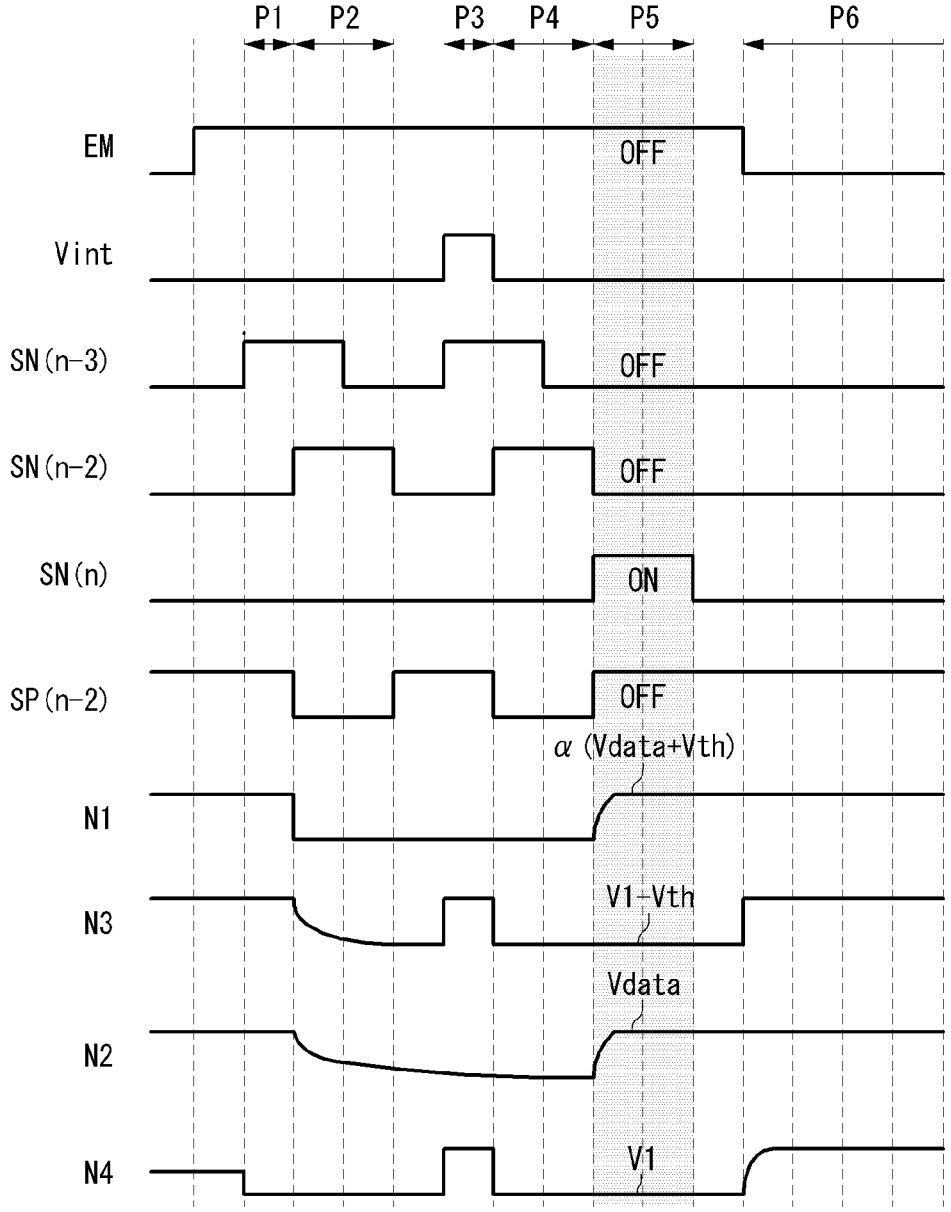

Referring to FIGS. 9A and 9B, in the fifth period P5, the third scan signal SN(n) is a gate-on voltage, and each of the remaining scan signals SN(n-3), SN(n-2) and SP(n-2), and the emission signal EM is a gate-off voltage. The third switching transistor T3 turns on by the third scan signal SN(n) which is a gate-on voltage and, as such, the data voltage Vdata is supplied from the data line 14 to the second node N2.

In the fifth period P5, the voltage of the first node N1 has a value α(Vdata+Vth) obtained by adding the threshold voltage Vth of the driving transistor DT to the data voltage Vdata because the second node N2 has the data voltage Vdata under the condition in which the potential difference between opposite electrodes of the first storage capacitor Cst1 is still maintained. Here, "α" represents a value obtained by dividing the capacitance of the first storage capacitor Cst1 by a sum of the capacitance of the first storage capacitor Cst1 and a total of parasitic capacitances connected to the first node N1. Since the capacitance of the first storage capacitor Cst1 is considerably greater than the total of the parasitic capacitances connected to the first node N1, "α" approximates to 1 and, as such, may be neglected.

In the fifth period P5, the charge amount accumulated in the first storage capacitor Cst1 does not vary, and only the potentials at the opposite electrodes of the first storage capacitor Cst1 vary at the same rate. Accordingly, in the fifth period P5, the time taken for the potential of the first node N1 to be set to the data voltage Vdata (exactly, a data voltage in which the threshold voltage is reflected) is reduced.

In the fifth period P5, the voltage of the first node N1 is "α(Vdata+Vth)", the voltage of the second node N2 is the data voltage Vdata, the voltage of the third node N3 is "Vint-Vth", and the voltage of the fourth node N4 is the first initialization voltage V1.

Figure 10A:
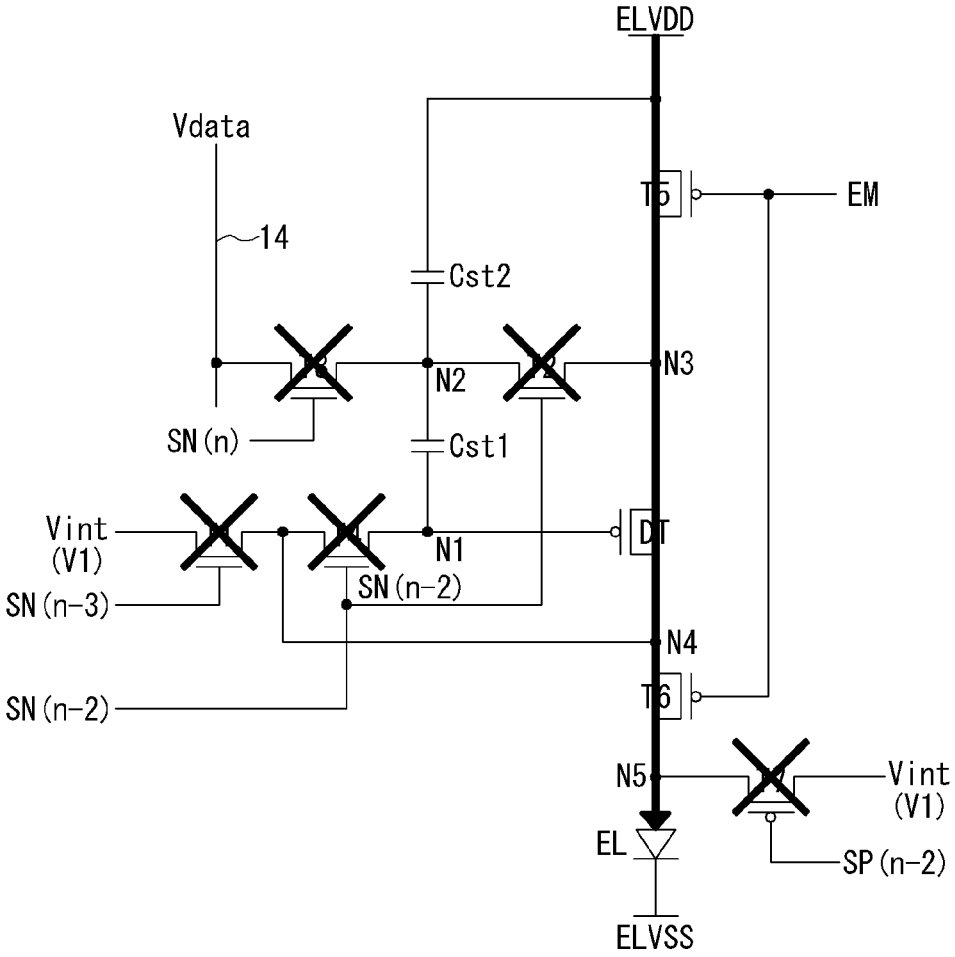
FIGS. 10A and 10B are diagrams associated with operation of each pixel in a period P6 of FIG. 4.
Figure 10B:
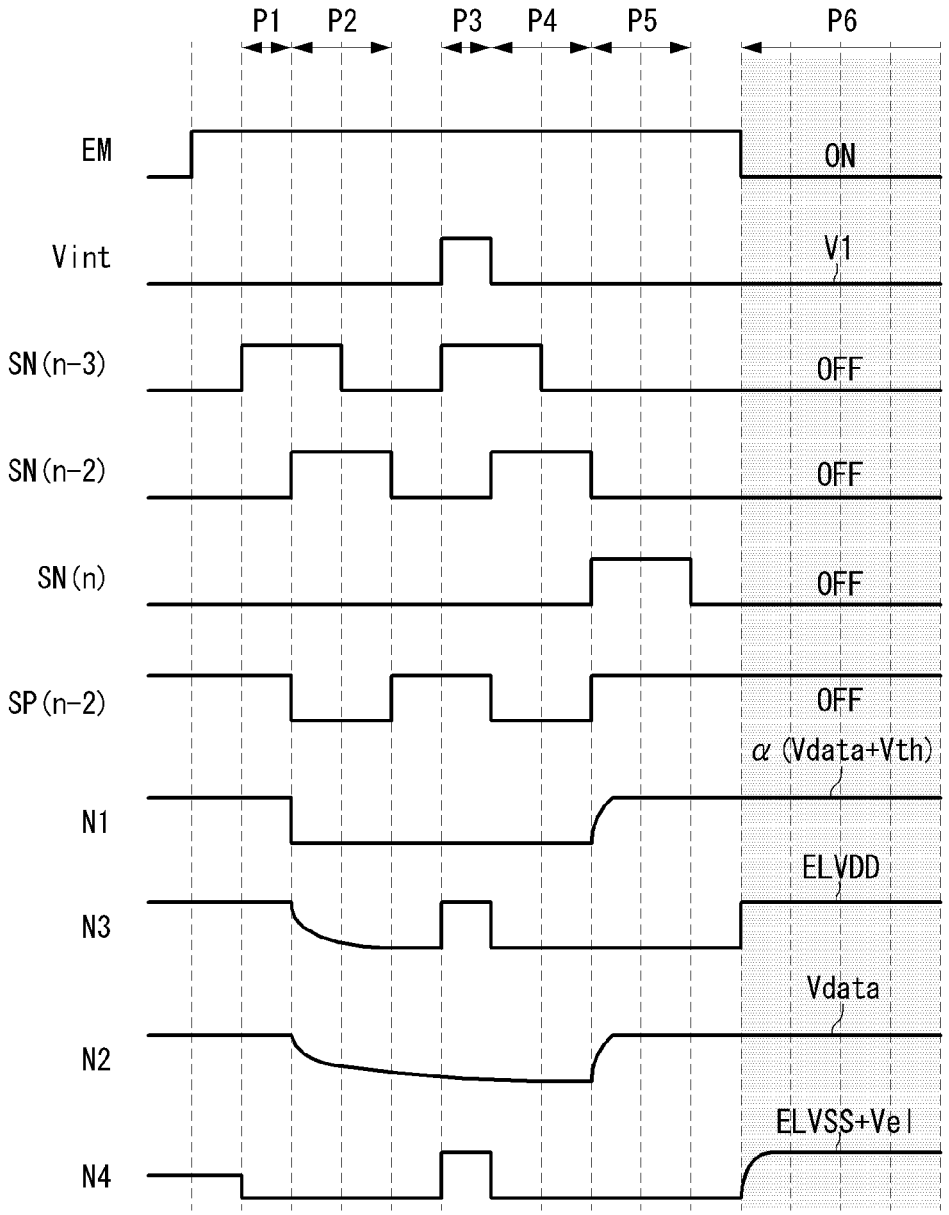

Referring to FIGS. 10A and 10B, in the sixth period P6, each of the first to fourth scan signals SN(n-3), SN(n-2), SN(n), and SP(n-2) is a gate-off voltage, and the emission signal EM is a gate-on voltage. All of the first to fourth switching transistors T1 to T4, and the seventh switching transistor T7 turn on, but the fifth and sixth switching transistors T5 and T6 turn on by the emission signal EM. In addition, the high-level source voltage ELVDD is input to the third node N3, and the voltage of the first node N1 is maintained at a voltage value α(Vdata+Vth) lower than the high-level source voltage ELVDD. Accordingly, the driving transistor DT turns on, thereby resulting in flow of pixel current. Such pixel current is applied to the light emitting element EL which, in turn, emits light.

Pixel current $I_{EL}$ is proportional to a square of a value obtained by deducting the threshold voltage Vth of the driving transistor DT from the gate-source voltage Vgs of the driving transistor DT, and may be expressed by the following Expression 1:

$$I_{EL} \propto (\mathrm{Vgs}-\mathrm{Vth})^2 = (a(\mathrm{Vdata}+\mathrm{Vth})-\mathrm{ELVDD}-\mathrm{Vth})^2 = (a\mathrm{Vdata}-\mathrm{ELVDD})^2 \quad \text{[Expression 1]}$$

As shown in Expression 1, components of the threshold voltage Vth of the driving transistor DT are erased in the relational expression of the pixel current $I_{EL}$ and, as such, the pixel current $I_{EL}$ may be determined irrespective of a variation in the threshold voltage of the driving transistor DT. The pixel current $I_{EL}$ is a value corresponding to a difference between the data voltage Vdata and the high-level source voltage ELVDD, and may enable the light emitting element EL to emit light. The potential of the anode of the light emitting element EL rises to a turn-on voltage ELVSS+Vel by the pixel current $I_{EL}$. From the potential rising time, the light emitting element EL may begin to emit light.

In accordance with each of the aspects of the present disclosure, it may be possible to alleviate hysteresis characteristics of a driving transistor before a gate-source voltage of the driving transistor is programmed by applying relatively strong on-bias to the driving transistor using an aging period preceding a programming period. Accordingly, it may be possible to optimally compensate for threshold voltage variation of the driving transistor.

In accordance with each of the aspects of the present disclosure, an internal compensator is included in each pixel circuit in order to prevent threshold voltage variation of the driving transistor from being reflected in pixel current. Accordingly, an enhancement in picture quality may be achieved.

In each of the aspects of the present disclosure, switching transistors directly/indirectly connected to the gate of the driving transistor are embodied as oxide transistors having excellent off characteristics. Accordingly, the gate voltage of the driving transistor may be continuously maintained at a programmed voltage even during light emission of a light emitting element and, as such, an enhancement in picture quality may be achieved.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An electroluminescent display device having a plurality of pixels, each of the pixels comprising:

a driving transistor having a gate connected to a first node, a source connected to a third node, and a drain connected to a fourth node, the driving transistor generating pixel current corresponding to a data voltage when a high-level source voltage is applied to the third node;

an internal compensator comprising a first capacitor connected between the first node and a second node, and a second capacitor connected between the second node and an input terminal for the high-level source voltage, the internal compensator controlling a threshold voltage of the driving transistor in an aging period and a programming period set with reference to a first scan signal, a second scan signal opposite to the first scan signal in phase, a third scan signal lagging the first scan signal in phase, a fourth scan signal leading the first scan signal in phase, and an emission signal;

a light emitting element connected between a fifth node and an input terminal for a low-level source voltage; and a first switching transistor configured to apply an initialization voltage to the fourth node in accordance with the fourth scan signal in the aging period preceding the programming period.

2. The electroluminescent display device according to claim 1, wherein the internal compensator controls voltages of the first to fifth nodes in accordance with operations of a plurality of switching transistors in the aging period and a the programming period set with reference to the first to fourth scan signals and the emission signal such that the threshold voltage of the driving transistor is reflected in a gate-source voltage of the driving transistor in an emission period following the programming period.

3. The electroluminescent display device according to claim 2, wherein the internal compensator controls the gate-source voltage of the driving transistor to have a first level including the threshold voltage in the programming period, based on a first initialization voltage and the data voltage, and wherein the internal compensator controls the gate-source voltage of the driving transistor to have a second level higher than the first level in the aging period preceding the programming period, based on a second initialization voltage higher than the first initialization voltage.

4. The electroluminescent display device according to claim 3, wherein the driving transistor turns on by the gate-source voltage having the first level or the second level, and wherein the gate-source voltage of the driving transistor is higher in the aging period than in the programming period.

5. The electroluminescent display device according to claim 3, wherein the programming period comprises an initialization period and a data writing period following the initialization period, wherein the internal compensator controls operations of the switching transistors such that the first initialization voltage is applied to the first, fourth and fifth nodes in the initialization period, and wherein the internal compensator controls operations of the switching transistors such that the data voltage is applied to the second node in the data writing period.

6. The electroluminescent display device according to claim 5, wherein the internal compensator further comprises:

a second switching transistor configured to connect the second node and the third node in accordance with the first scan signal, which has an ON level, in the initialization period, thereby applying a first voltage obtained by deducting the threshold voltage of the driving transistor from the initialization voltage to the second and third nodes;

a third switching transistor configured to apply the first initialization voltage to the first node in accordance with the first scan signal, which has an ON level, in the initialization period;

a fourth switching transistor configured to apply the first initialization voltage to the fifth node in accordance with the second scan signal, which has an ON level, in the initialization period;

a fifth switching transistor configured to apply the data voltage to the second node in accordance with the third scan signal, which has an ON level, in the data writing period;

a sixth switching transistor configured to electrically connect the input terminal for the high-level source voltage and the third node in accordance with the emission signal, which has an ON level, in the emission period; and a seventh switching transistor configured to electrically connect the fourth node and the fifth node in accordance with the emission signal, which has an ON level, in the emission period, wherein the first switching transistor configured to apply the second initialization voltage to the fourth node in accordance with the fourth scan signal, which has an ON level, in the aging period.

7. The electroluminescent display device according to claim 6, wherein each of the first switching transistor and the third switching transistor includes an N-channel oxide transistor having an oxide semiconductor layer.

8. The electroluminescent display device according to claim 6, wherein each of the second switching transistor and the fifth switching transistor includes an N-channel oxide transistor having an oxide semiconductor layer.

9. The electroluminescent display device according to claim 6, wherein each of the driving transistor, the fourth switching transistor, the sixth switching transistor and the seventh switching transistor includes a P-channel low-temperature polysilicon LTPS transistor having an LTPS semiconductor layer.

10. The electroluminescent display device according to claim 5, wherein the internal compensator further controls operations of the switching transistors such that the first initialization voltage is previously applied to the first node in a pre-initialization period prior to the aging period.

11. The electroluminescent display device according to claim 10, wherein each of the first, second and fourth scan signals is input at a primary ON-level in the pre-initialization period.

12. The electroluminescent display device according to claim 11, wherein each of the first, second and fourth scan signals is input at a secondary ON-level in the programming period.

13. The electroluminescent display device according to claim 5, wherein the first capacitor stores the threshold voltage of the driving transistor in the initialization period, and wherein the second capacitor stores the data voltage in the data writing period.

14. The electroluminescent display device according to claim 1, wherein, when a first image frame and a second image frame, in which the data voltage is written in the pixels, are present, a plurality of third image frames, in which the data voltage written in the first image frame is maintained, is disposed between the first image frame and the second image frame.

15. An electroluminescent display device having a plurality of pixels, each of the pixels comprising:

a driving transistor having a gate connected to a first node, a source connected to a third node, and a drain connected to a fourth node, the driving transistor generating pixel current corresponding to a data voltage when a high-level source voltage is applied to the third node;

a light emitting element connected between a fifth node and an input terminal for a low-level source voltage, and an internal compensator comprising a second node coupled to the first node, and controlling a threshold voltage of the driving transistor with reference to a first scan signal, a second scan signal opposite to the first scan signal in phase, a third scan signal lagging the first scan signal in phase, a fourth scan signal leading the first scan signal in phase, and an emission signal and controlling voltages of the first to fifth nodes in accordance with operations of a plurality of switching transistors during an aging period and a programming period set with reference to the first to fourth scan signals and the emission signal such that the threshold voltage of the driving transistor is reflected in a gate-source voltage of the driving transistor in an emission period following the programming period, and wherein the internal compensator controls the gate-source voltage of the driving transistor to have a first level including the threshold voltage in the programming period, based on a first initialization voltage and the data voltage, and wherein the internal compensator controls the gate-source voltage of the driving transistor to have a second level higher than the first level in the aging period preceding the programming period, based on a second initialization voltage higher than the first initialization voltage.

16. The electroluminescent display device according to claim 15, wherein the driving transistor turns on by the gate-source voltage having the first level or the second level, and wherein the gate-source voltage of the driving transistor is higher in the aging period than in the programming period.

17. The electroluminescent display device according to claim 15, wherein the programming period comprises an initialization period and a data writing period following the initialization period, wherein the internal compensator controls operations of the switching transistors such that the first initialization voltage is applied to the first, fourth and fifth nodes in the initialization period, and wherein the internal compensator controls operations of the switching transistors such that the data voltage is applied to the second node in the data writing period.

18. The electroluminescent display device according to claim 17, wherein the internal compensator further comprises:

a first switching transistor configured to apply the second initialization voltage to the fourth node in accordance with the fourth scan signal, which has an ON level, in the aging period;

a second switching transistor configured to connect the second node and the third node in accordance with the first scan signal, which has an ON level, in the initialization period, thereby applying a first voltage obtained by deducting a threshold voltage of the driving transistor from the initialization voltage to the second and third nodes;

a third switching transistor configured to apply the first initialization voltage to the first node in accordance with the first scan signal, which has an ON level, in the initialization period;

a fourth switching transistor configured to apply the first initialization voltage to the fifth node in accordance with the second scan signal, which has an ON level, in the initialization period;

a fifth switching transistor configured to apply the data voltage to the second node in accordance with the third scan signal, which has an ON level, in the data writing period;

a sixth switching transistor configured to electrically connect the input terminal for the high-level source voltage and the third node in accordance with the emission signal, which has an ON level, in the emission period; and a seventh switching transistor configured to electrically connect the fourth node and the fifth node in accordance with the emission signal, which has an ON level, in the emission period.

19. The electroluminescent display device according to claim 17, wherein the internal compensator further controls operations of the switching transistors such that the first initialization voltage is previously applied to the first node in a pre-initialization period prior to the aging period.

* * * * *